United States Patent [19]

Hubler

[11] Patent Number: 4,523,750

[45] Date of Patent: Jun. 18, 1985

[54] COPIER/DUPLICATOR WITH FINISHING APPARATUS HAVING LOW STAPLE CONTROL FEATURES

[75] Inventor: Lawrence C. Hubler, Fairport, N.Y.

[73] Assignee: Xerox Corporation, Stamford, Conn.

[21] Appl. No.: 645,645

[22] Filed: Aug. 30, 1984

[51] Int. Cl.[3] ..... B42B 1/02; B27F 7/06

[52] U.S. Cl. ..... 270/53; 227/2; 227/120; 355/14 CU; 364/187

[58] Field of Search ..... 270/53; 227/2, 3, 7, 227/119–120, 125, 129; 355/14 CU; 364/187

[56] References Cited

U.S. PATENT DOCUMENTS

| | | | |
|---|---|---|---|
| 4,134,672 | 1/1979 | Burlew et al. | 355/14 CU |
| 4,187,969 | 2/1980 | Spehrley, Jr. | 227/2 |
| 4,244,564 | 1/1981 | Brown | 270/53 |
| 4,281,920 | 8/1981 | Cross | 270/53 |
| 4,386,725 | 6/1983 | Chambers | 227/2 |
| 4,421,404 | 12/1983 | Conly | 355/14 CU |
| 4,444,491 | 4/1984 | Rinehart et al. | 270/53 |

*Primary Examiner*—E. H. Eickholt

*Attorney, Agent, or Firm*—Bernard A. Chiama

[57] ABSTRACT

A control system for a copier having at least one stapler for inhibiting the start of production by the copier in the event the number of staples is less than the number of copy sets to be stapled with the stapler. The system includes a sensing device adapted to produce a low staple signal when an approximated predetermined number of staples remain. The presence of this signal will permit continuation of the compilation of the copy set then being produced, or the compilation of copy sets in a sorter array associated with the copier and stapling thereof, and then inhibit the restart of the copier thereafter.

4 Claims, 7 Drawing Figures

COPIER/DUPLICATOR WITH FINISHING APPARATUS HAVING LOW STAPLE CONTROL FEATURES

This invention relates to an improved reproduction or copying machine, having an improved finishing station for use in such system, and particularly for controlling the status of operation of the system when material for finishing depletes or has depleted to a quantity less than needed for a programmed job.

Generally, copying machines having one or more stapling or stitching devices as a binding apparatus associated therewith, are arranged to detect low staple or wire supply conditions and to warn the operator of their existence. Upon this occurrence, when the supply has been detected as low or non-existent, the copying machine merely shuts down without prior warning and in the middle of a production job. In shutting down, the count of the job so far produced is lost and the operator must personally count the number of stapled or stitched copy sets completed, and to reset the machine programmer for the remaining copy sets to be produced, after, of course, the staple or wire supply has been replenished.

In copying machines having a sorter intermediate the copy sheet processor and the binding apparatus for post-collation of copy sets in multiples of the number of bins in the sorter, the problem is compounded in the event that the machine shuts down for lack of staples during binding of the copy sets already collected in the array. If the array is located in the machine in a semi-accessible location for safety purposes, the operator will be required to retrieve some sets which are completed but not stapled, and to handle in the best way possible the copy sets not completed. The possibility of achieving job recovery is next to impossible. Therefore, the principal object of the present invention is to prevent operation of a copying machine having a copy set binding apparatus in the event that the number of staples or wire in the binding apparatus is lower than the programmed number of copy sets to be stapled or stitched.

Another object of the invention is to permit completion of the binding of copy sets already completed in a copying machine having multiple copy set collation trays but to inhibit operation of the copying machine in the event the binding material is insufficient to effect binding of all of the completed sets in the multiple trays.

The use of low staple sensors is well known. In U.S. Pat. No. 4,187,969, a sensor is utilized to view the presence or absence of staples at a predetermined point in a staple magazine as indicative of a predetermined quantity of staples remaining. When below this quantity, a signal is generated to effect supplying another staple stick into the magazine. In U.S. Pat. No. 4,386,725, a similar sensing arrangement is described, and the signal generated thereby serves to warn the operator, and to place the machine in Standby condition.

In accomplishing the present invention, a copy set finishing station for binding copy sheets is arranged to receive copy sheets from a copy sheet processor and to collate the sheets into multiple collecting trays. A set transport device removes each set of collected sheets from the bins and transports the sets to a pair of stapler devices for binding each set after removal from the trays. Each of the stapler devices includes a staple sensor which is arranged to detect approximately a predetermined number of staples remaining and to produce a signal indicative thereof. The sensor device and circuit therefor is connected to the control programmer for the processor and finishing station and is devised so that upon reaching the pedetermined number, the production job in progress will be allowed to continue only for completing the copy sets being collated and bound in the multiple collecting trays at the time of sensing and will inhibit further operation of the processor. The processor will resort to its standby mode and will keep the count of the job so far accomplished so that upon reloading of the staple supply and restarting of the processor, the job will resume from the point whereat the processor went to its standby mode.

In a broader aspect of the invention, a single compiler tray may be utilized and the remaining number of staples may be compared to a programmed job so that if there is not sufficient staples to complete that job, the copier will be inhibited from operation until the operator adds staples. This comparison may be accomplished by the use of counters and comparison circuits. Another broad aspect of the invention is that the invention applies to stitchers as well as staplers, and instead of using the count of remaining staples, the amount of remaining wire stock for a stitcher is monitored.

The present invention is an improvement of the copying system disclosed in U.S. Ser. No. 563,735, filed Dec. 21, 1983, commonly assigned, with regard to the low staple sensing control.

Other objects and advantages will be apparent from the ensuing description and drawings in which.

Figure 5A:
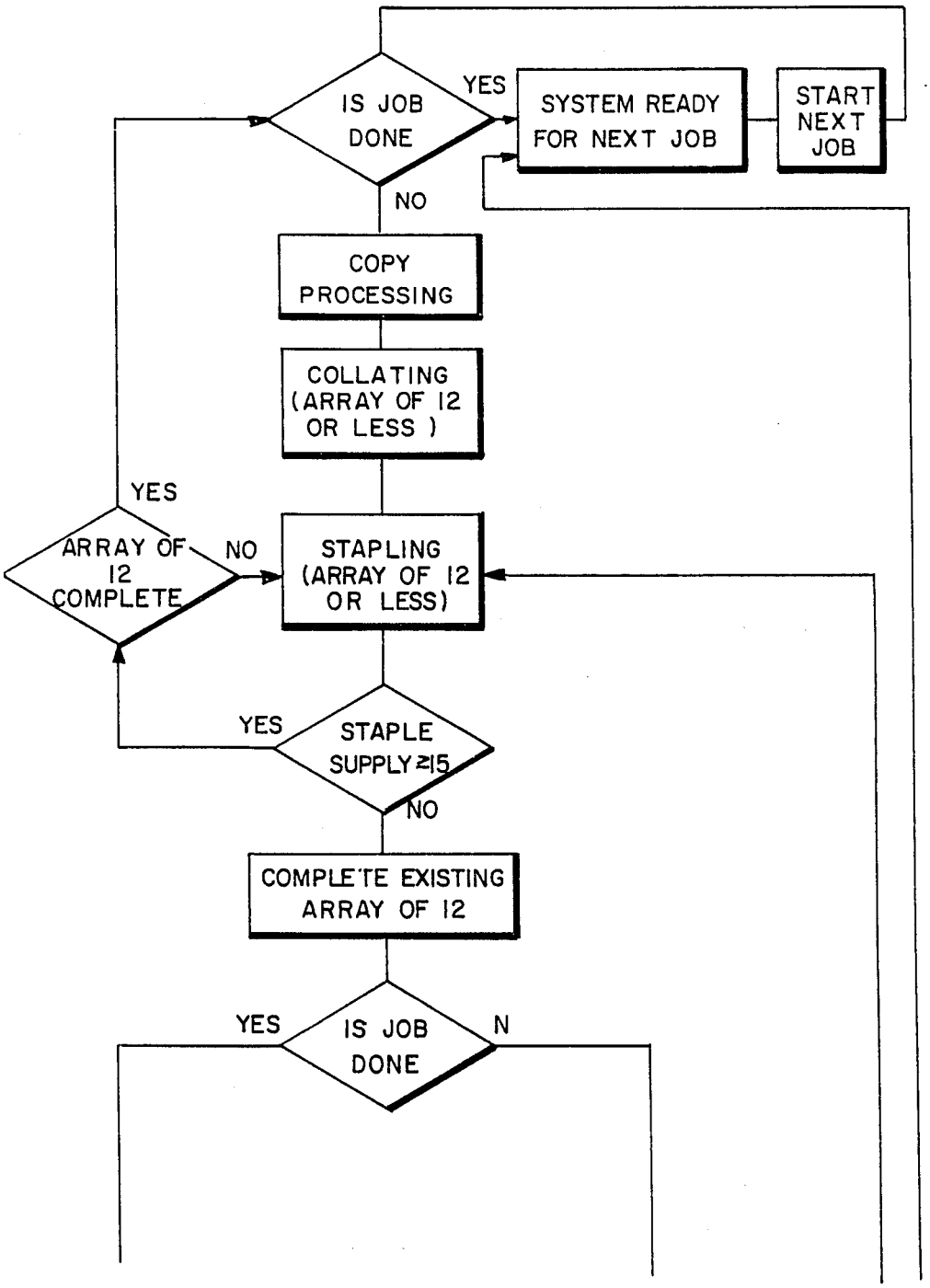
Figure 5B:
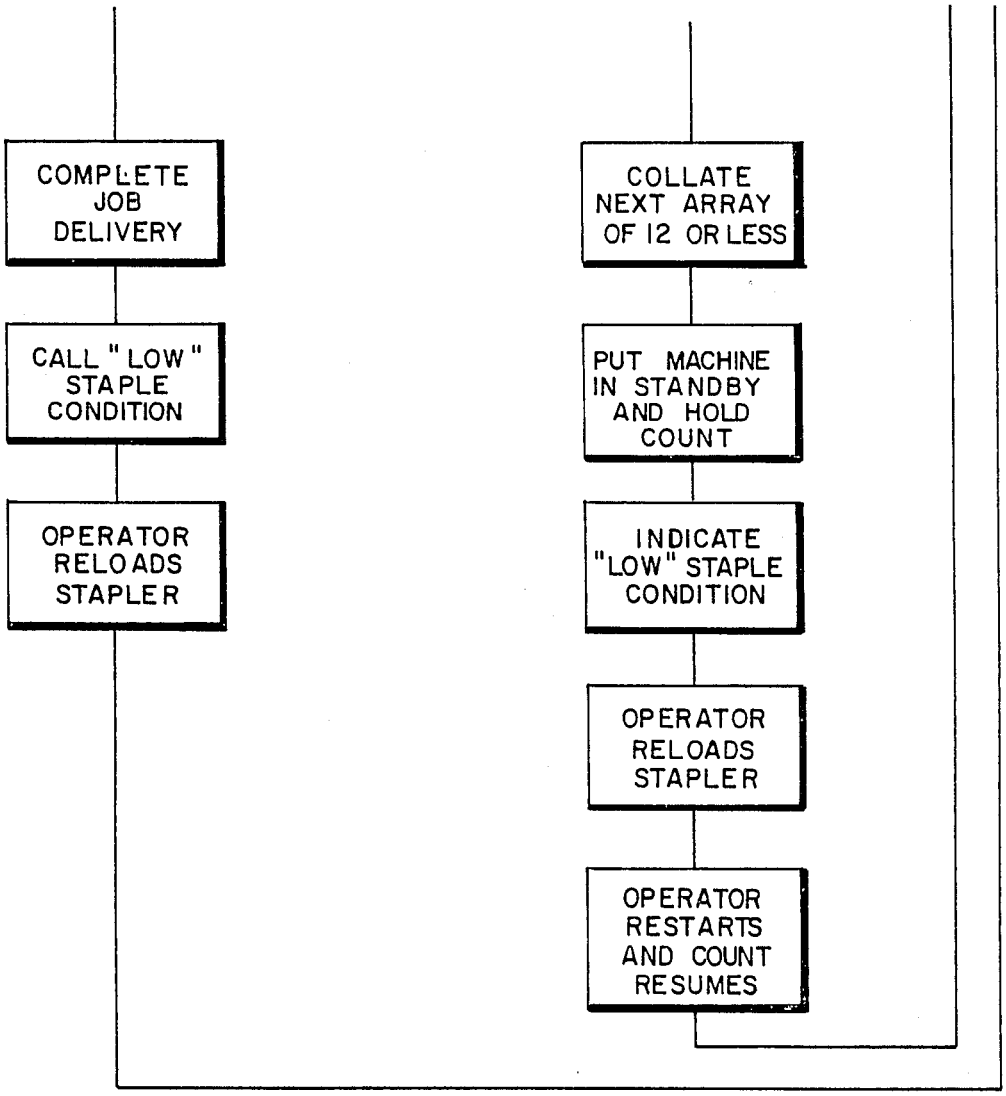
Figure 6:
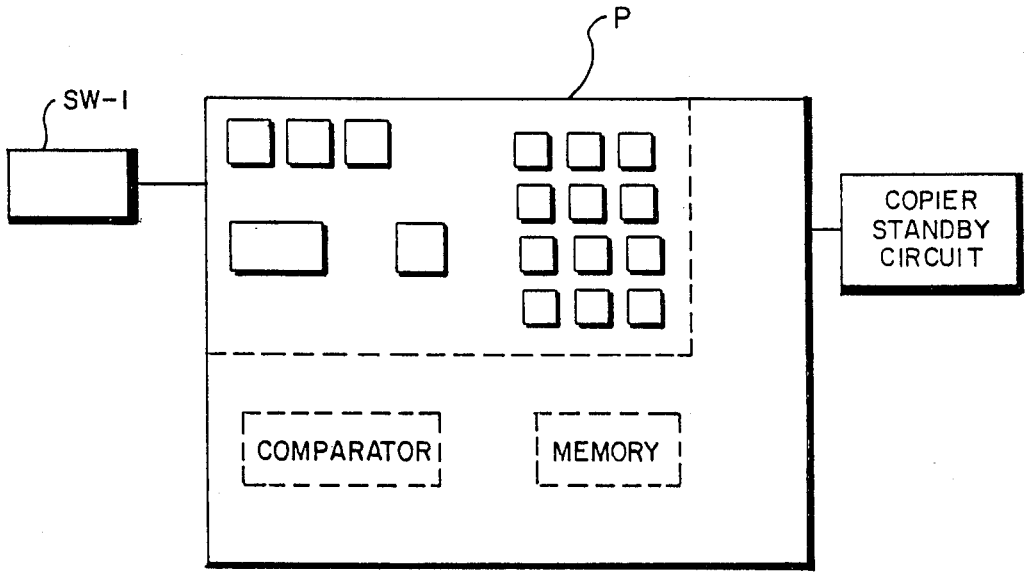

FIGS. 5*a* and 5*b* are flow diagrams of the control function of the present invention; and FIG. 6 is a circuit diagram of the control arrangement.

Figure 1:
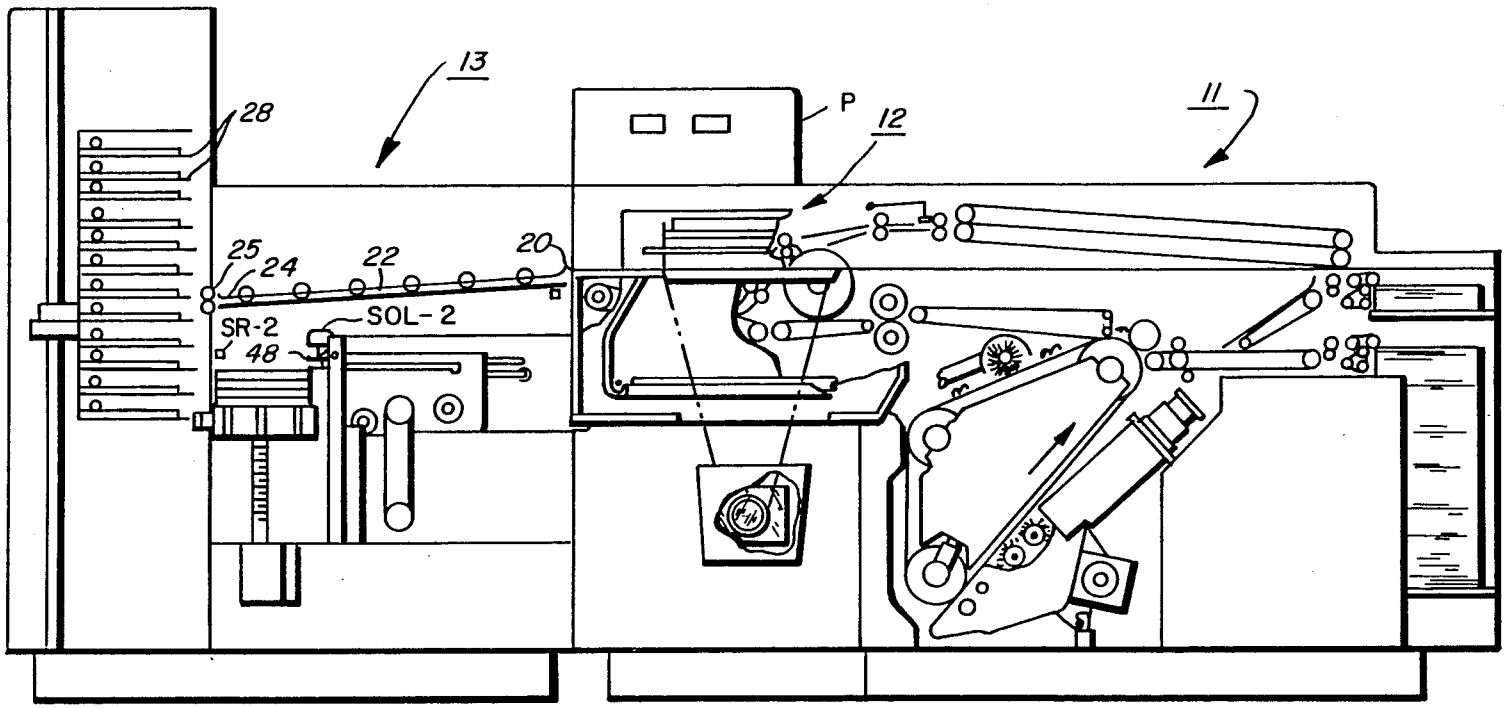
FIG. 1 is a schematic illustration of a configuration of an electrostatographic printing/stapling system employing the present invention.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably, the processor 11 is the same as the processor in the commercial embodiment of the Xerox duplicators, models 9400® and 9500® which utilize flash, full frame exposure, for very high speed production. Similarly, the document handling apparatus 12 is the same as those used in the same machines. It will be understood that most any other type of xerographic processor and document handling apparatus, including the recirculating type, may be utilized. Operating in conjunction with the processor 11 and apparatus 12 is a finishing station 13 and thereby forms the reproduction system shown in FIG. 1.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, staples or unstapled; to select one of a plurality of paper trays; to condition the machine for the type of document, that is, whether one sided or two sides, to select a copy size reduction mode, and other desirable functions. The programmer P also includes a controller which provides all operational timing and synchronizing between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calif., and having sufficient ROM's and RAM's for all the necessary functions in the reproduction system.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein. For the complete apparatus and description thereof to which the present invention may be applied is illustrated and described in U.S. Pat. No. 4,444,491 commonly assigned, and which is incorporated by reference herein.

Copy sheets exiting the processor 11 are transported through an exit slot 20. The sheets are directed to the finishing station 13 which comprises a sorting mechanism, a stapler apparatus, and an output elevator/conveyor system. After leaving the processor 11, as shown in FIG. 1, each sheet is positioned upon a transport 22 to be further conveyed generally along the same horizontal plane as its previous path to a fixed receiving point or station 24.

At the exit slot 20, a sheet contacting switch SR-1 is positioned to be actuated as each sheet enters the transport 22 of the finishing station 13. The circuit for this switch is connected to the logic in the programmer P and serves to reset the machine clock for the finishing function so that zero time for the sheet commences when the sheet is at the reference point 24.

At the receiving station 24, there is positioned a pair of contacting transport rollers 25 which receive each copy sheet within the nip for directing a sheet into a bin of an array of collecting bins, or sorter generally indicated by the reference numeral 28. In the illustrated embodiment, the array 28 includes twelve horizontally disposed bins 30 arranged in a vertical column, the number of which corresponds to the predetermined number of exposures made of each document sheet while it is on the exposure platen for the copy processor 11.

The array 28 is mounted for bi-directional vertical indexing movement within a supporting fixed machine frame 32 and is positioned in its normal standby position with the lowermost bin opposite the nip of the rollers 25 at the fixed station 24. Details as to structural and operating sequences is described in the above referenced U.S. Pat. No. 4,444,491.

As will be described hereinafter, a set stapling system in the form of a dual stapler apparatus is arranged immediately below the bin receiving point 24. This apparatus includes means to remove completed sets of collated copy sheets from every other bin to effect single or dual stapling along an edge of the set if so programmed or not stapling at all, and to position the stapled or unstapled sets on an elevator mechanism. In order to permit complete removal of the sets from all of the bins 30 in the array 28 for stapling purposes, the array must move twice relative to the point of set unloading.

The bin arry 28 is driven vertically in either direction by a ball screw 34 connected to the shaft of a suitable servo mounted to the base of the frame 32. These movements of the array are effected by an internally threaded ball 35 secured to a rear wall of the array and through which the screw 34 is threadedly related. Rotation of the screw (which is fixed against axial movement) in either direction will impart corresponding up or down movement of the ball 35, and consequently the array.

Figure 2:
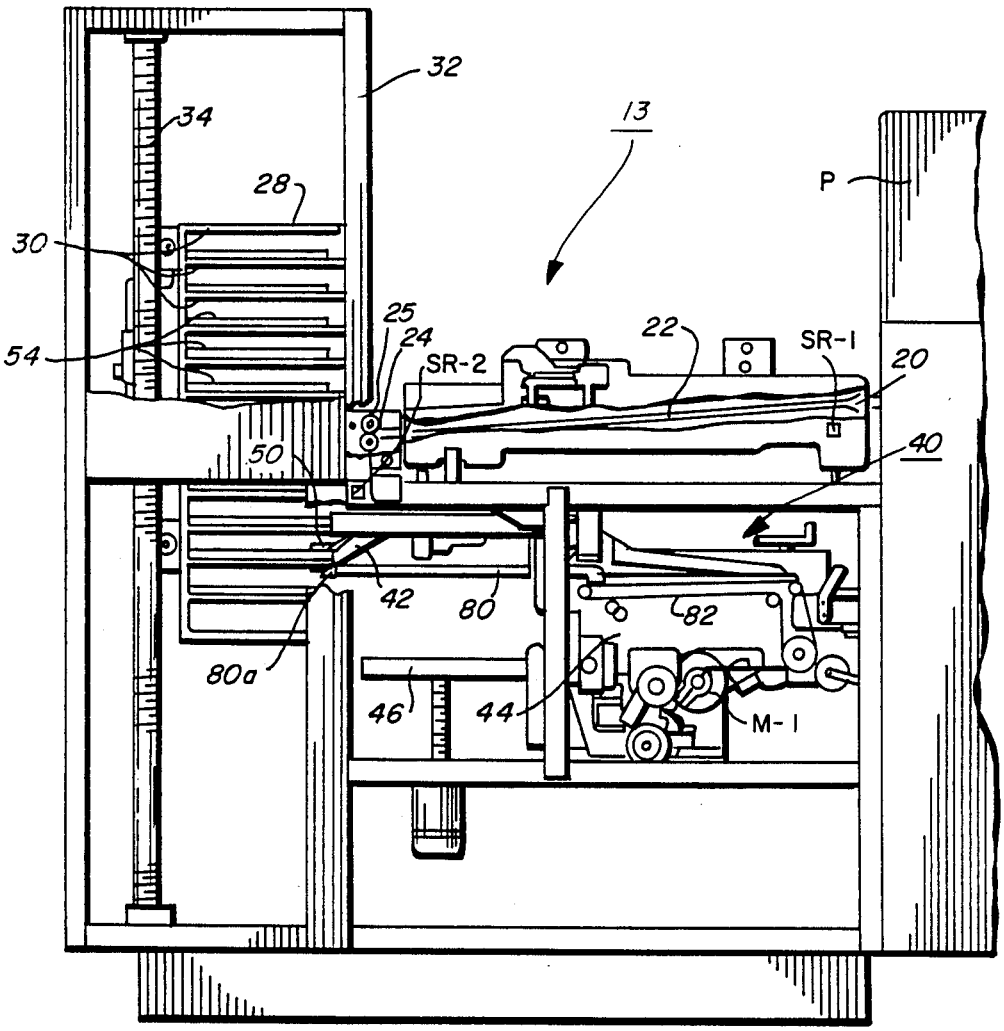
FIG. 2 is an elevational view of the stapling station utilized in the system of FIG. 1.

After copy sheets, simplex or duplex, have been produced in the processor 11, transported by the transport 22 and collected in the bin array 28 while the system is in either the sets mode or the stacks mode, the collected sets are now in condition to be further processed by a finishing apparatus generally indicated by the reference number 40. The finishing apparatus 40 comprises subassemblies each of which is programmed to operate in timed sequence with each other, with the system logic and programmer P, to be timed relative to the number of sets and copy sheets per set which were previously pre-programmed, and with the document sheet actuation of the apparatus 12. As shown in FIG. 2, the finishing apparatus comprises a set transport 42, individually operable, and dual stapler devices 44. In conjunction with the finishing apparatus 40, the finishing station 13 also includes an elevator 46.

The set transport 42 is utilized to unload automatically sets or stacks of copy sheets from the bins at an unload station two copy cycle pitches or bins below the sorter bin load station at 24. As shown in FIG. 2, the set transport includes a clamp 48 which is adapted to grip an edge of a set or stack and convey the same from the bin array to the stapler apparatus 40 for a stapling operation, if that has been pre-programmed, or directly to the elevator 46 if programmed for the non-stapled mode.

The set transport 42 also includes a reversible servo motor (not shown) to effect reciprocable movement of the clamp 48 to the sorter to a set gripping position, in the opposite direction to a set stapling position, and still further in that direction, to retract the clamp, all in cyclic actuation. In moving toward the sorter 28, the clamp 48 is sensed by a sensor SR-2 mounted on the frame for the sorter to zero reference the positioning of the set transport as a timing monitor of subsequent timed events in the finishing function. The clamping and unclamping action of the clamp is provided by a solenoid valve in a suitable pneumatic power device which may be operatively connected to the jaws.

The stapler apparatus 40 as shown in FIG. 2 provides a stapling function either with a single staple or with two staples, both being adapted to be applied at various positions along a long edge of a set or stack of copy sheets. Stapling is achieved by way of two identical mechanisms, each of which provides the function of set clamping, staple driving, and staple clinching. Preferably, the apparatus utilizes two commercial type stapler heads 50, such as the Bostitch staple head indicated as the 64-E manufactured by the Bostitch Division of Textron Corporation of Providence, R. I. Since the stapler mechanisms, drives therefor, and related structure are identical, only one will be described.

Figure 3:
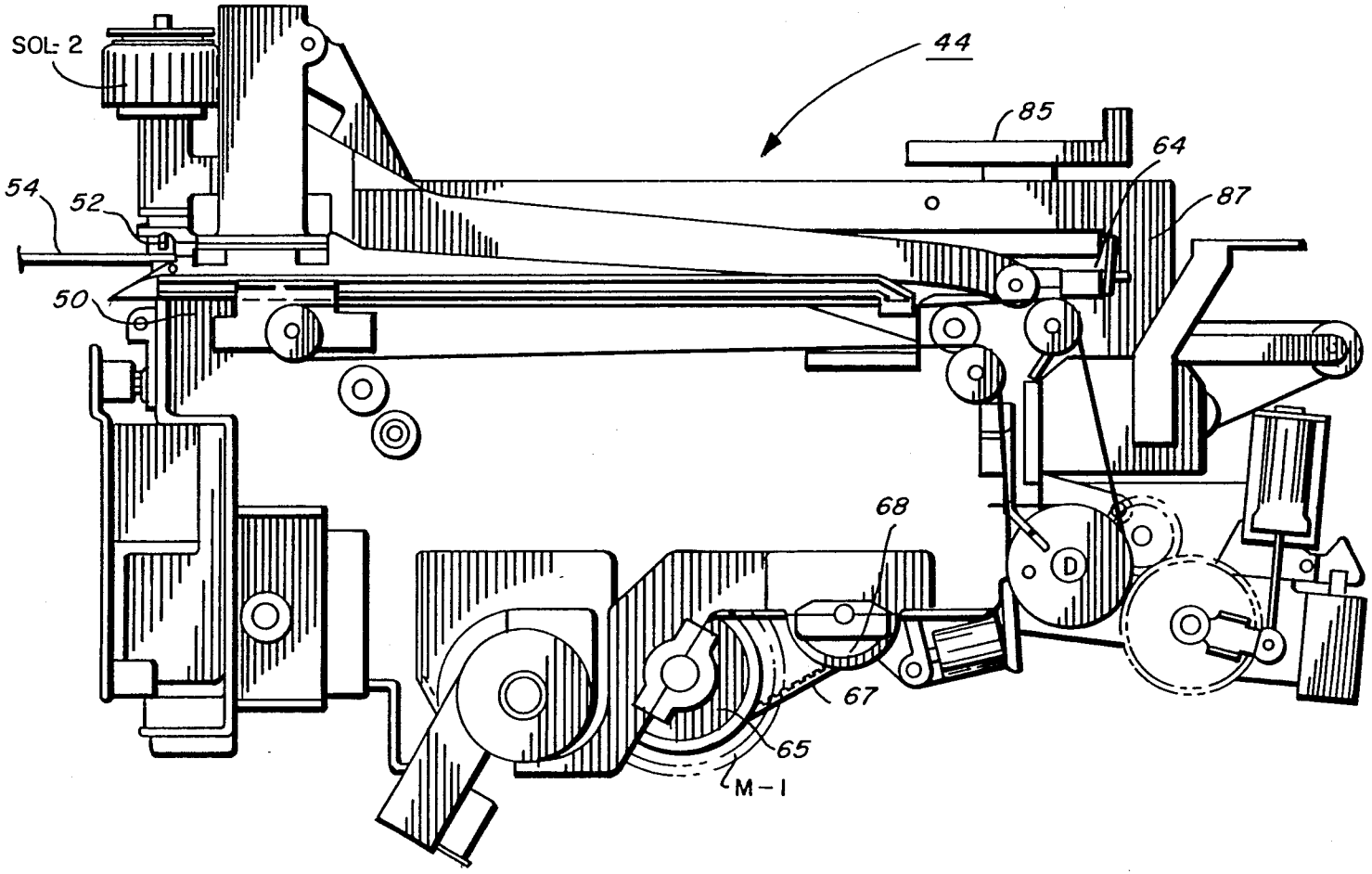
FIG. 3 is an elevational view of one of the stapling devices in the stapling station of FIG. 2.

As shown in FIG. 3, the stapler device 44 comprises the stapler head 50 having a clamping position 52 to which an edge of each copy set 54 is transported by the set transport 42. At the position 52, the stapler head 50 is adapted, upon energization of a solenoid SOL-2 to effect clinching of the legs of a staple after the same has been separated from a stick of staples within a staple magazine 64 in the head 50, driven by a driver (not shown) in the head 50 through the sheets of the copy set in the conventional manner. With one or more staples being driven through the sheets of the copy sets, clinching of the staple legs is then accomplished by the energization of the solenoid SOL-2, as aforesaid.

Stapling in the stapling device 44 is accomplished by a drive system including a drive pulley 65 connected to the shaft of a drive motor M-1 for driving both devices 44. Further details of this drive system and staple drive is fully disclosed in the above referred to U.S. Pat. No. 4,444,491 which is hereby incorporated by reference and therefore are not necessary for understanding the present invention.

Figure 4:
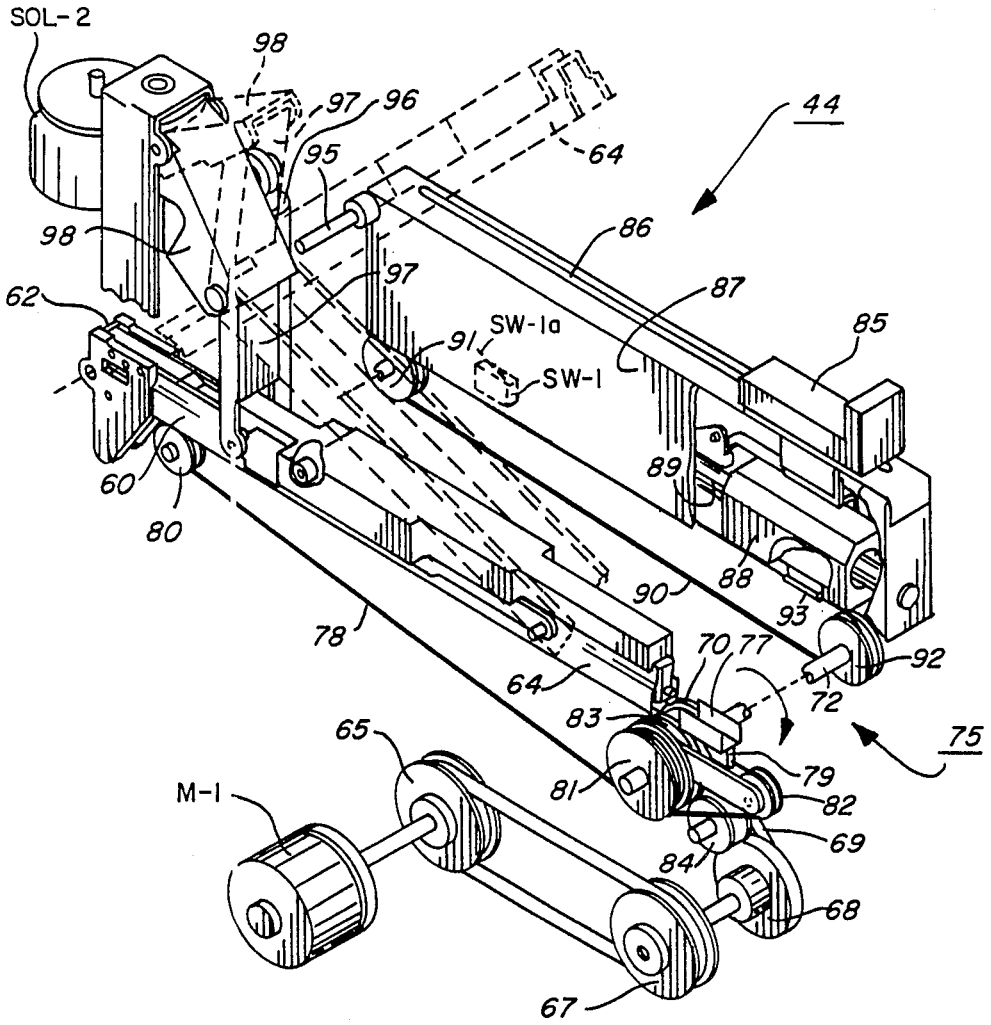
FIG. 4 is an isometric view of a stapling device showing full line arrangement in readiness for a staple feed operation and dotted line arrangement for staple loading operation.

As shown in FIGS. 3 and 4, the pulley 65 for the motor M-1 is connected by a timing belt to a pulley 67 mounted on a shaft supporting a pulley 68 which in turn, is connected by a timing belt 69 to drive a slip or over-running one way clutch 70 secured to a shaft 72 of a drive mechanism generally indicated by the reference numeral 75 (see FIG. 4). The drive mechanism 75 is utilized to drive a staple follower or slipper against the rear end of a row of staple sticks in each of the stapler heads 50 for the stapler devices 44 in one mode of operation and to drive the staple slipper rearwardly and out of the stapler head to permit reloading of staples, in another mode of operation.

As shown in FIG. 4, the staple head magazine 64 is elongated and of a length preferably adapted to contain four or five commercial staple sticks of about 165 staples each. The magazine is of the conventional type as in most desk-type staplers except that the channel within the head is inverted so that the staples contained therein have their legs extending upwardly. A staple follower or slipper 77 is shown removed from the magazine preparatory to the reloading of the magazine, as will be described below.

The follower 77 is adapted to be driven very slowly within and along the channel formed in the magazine throughout most of its length, driving therewith the staples before it. At the other end of the magazine, at the clamping position 52, staples are driven one a a time from the adjacent end of a stick of staples in the customary operation of the staple device 44.

As the staples are consumed, the follower 77 travels toward the position 52. This forward motion is imparted to the follower 77 by means of a cable 78 to which the follower is attached by an external clip 79. The cable 78 extends along the longitudinal axis of the magazine 64 from the clip 79 forward to and around a pulley 80 secured to the frame of the stapler device, then returning to the rear of the magazine, around a capstan pulley 81 for a few turns, then around a more rearward positioned pulley 82 back to the support clip 79. The capstan pulley 81 is secured to the shaft 72 and has mounted thereon and concentric therewith a constant torque spring 83 which has its inner end secured to the shaft 72. The other end of the spring 83 is connected to a spring supply spool 84 secured to the stapler device.

In normal operation of the staple moving means so far described, the spring 83 has been wound by a mechanism to be described below. The magazine 64 has been fully loaded with staple sticks and the follower 77 is against the rearmost staple. The spring 83 supplies an even, constant and steady force upon the follower for the entire length of its travel to where a low staple condition is experienced as predetermined by machine conditions. Upon reaching a low staple condition, wherein a few staples remain of an approximate predetermined number, as detected by a switch SW-1, which has is actuator SW-1*a* is arranged in the path of movement of the follower 77, the control for the motor M-1 will assume operation as discussed below.

The switch SW-1 is operatively connected to the Programmer P which is also arranged to provide the operator with an indication that there is a low staple condition. The switch SW-1 then serves as a sensor and has its actuator placed so that when approximately 15 staples remain, the actuator will be engaged by the moving follower 77 to effect actuation of the switch. While 12 staples could have been chosen since there are 12 bins in the array 28, the number 15 provides somewhat of a safety factor against inaccuracies inherent in staple sensing devices. For example, more than likely, the staple in the driving groove for the stapler device which would be the first to be driven out of the device cannot be counted as one of the "remaining staples".

Upon the presence of approximately 15 staples in the magazine, a signal is generated for use in the Programmer P which continues to be generated as long as the number of staples remains below the number of 15. When a low staple condition is sensed and indicated, sufficient staples still remain in the magazine 64 to permit completion of a reproduction run for which stapling had been programmed or to a segment of the reproduction run which is a multiple or a division of the total number of copy sets to be produced. For example, if a low staple condition is sensed when the bin array 28 is only partially filled, the Programmer P will permit the completion of filling the bin array and the stapling of the resultant copy sets in the array before causing the system to assume a standby status. After any of these events, the motor M-1 will become deenergized to shut down the apparatus 40 and to place the printing system in its standby mode, awaiting the operator to load staples.

The return of the follower 77 to its retracted position as shown in FIG. 4, the wind up of the spring 83 and the additional conditioning of the magazine 64 for reloading is provided by a staple reload arrangement and drive therefor. The reload arrangement includes a manually operated latch mechanism having a handle 85 slidably mounted in an elongated slot 86 formed in a housing 87 mounted on the frame of the stapling apparatus. The slot is approximately 70% as long as the magazine and is mounted to be closely adjacent thereto. The handle 85 extends within the housing 87 and is mounted upon a member 88 which is supported for sliding movement upon an elongated rod 89 which extends the length of the housing.

A drive cable 90 supported for bidirectional movement below the housing 87 is entrained around a forward pulley 91 and a rear pulley 92 secured to the shaft 72, both being supported below the ends of the housing. The cable is secured to the latch member 88 by means of a bracket 93 so that upon reciprocable motion of handle 85, the cable 90 moves correspondingly therewith.

As shown in FIG. 4, the cables 78 and 90 are operative in parallel planes and the extent of movement of the follower 77 and the bracket 93, respectively, are the same in both direction and distance. The slip clutch 70 is mounted for operation on the shaft 72 with the pulley 92 with the slip of the clutch being such that as the shaft turns in the direction of the arrow, there is slippage in the pulley of the clutch and no drive is imparted to the belt 69 and pulley 68.

In operation of this portion of the staple load mechanism, after a low staple condition is sensed and the system has attained its standby status, the motor M-1 is deenergized. The operator manually returns the reload handle 85 to its rearmost position, as shown in FIG. 4, from a position which, at low staple condition, would be at the forward end of the slot 86 (left end as viewed in FIG. 4). This movement of the handle 85 produces corresponding movement of the upper run of the cable 90 which causes the shaft 72 to turn in the direction of the arrow. In this rotation, the clutch 70 slips and the spring 83 winds up upon the shaft 72. This rotation of the shaft 72 also produces rotation of the capstan pulley 81 to return the follower 77 to its most rearward position and out of the magazine 64, into a storage space, as shown in FIG. 4.

With the parts in their respective position as shown in FIG. 4 in full lines, the magazine may be pivoted to its position as shown in dotted lines about a pivot pin 95 secured to the forward end of the housing 87. A suitable latch, not shown, may be mounted on the housing 87 to permit the operator to lock the magazine during normal stapling operation and to release the magazine to its loading position as shown in dotted lines. While in the loading position, the operator may insert one to four stape sticks. A counterbalance device in the form of a gas cylinder 96 serves to articulate pivotally joined elements 97, 98 connected to the magazine adjacent the pivot pin 95 and the stapler frame. The gas cylinder serves to buckle the joined elements and thereby facilitate easy pivotal movement of the magazine to both of its positions. The motor M-1 serves as a brake to limit the speed of movement of the follower 77 under the force of the spring 83 until the follower contacts the end of the last stick of staples.

From the flow diagrams of FIGS. 5*a* and 5*b*, it will be seen that copy sheet processing and collation into the array of bins 28 continues as long as the staple supply is more than approximately 15 staples. In the event that this number is no longer present, the filling of the array 28 and the stapling of the completed copy sets is allowed to be completed in accordance with the programmed run. If this completion or partial completion does not finish the job, the array 28 is allowed to continue collecting and collating the copy sheets still moving through the system until the array is filled once again. No stapling is allowed during this phase of operation, and upon filling of the array, the copying system goes into standby condition with the count of so-far completed sets being held in the Programmer P. A Low Staple indication is presented on the system console for operator warning and action.

After the operator reloads the stapler 44 with staples and actuates the "Start" switch for the system, the collated copy sets in the array 28 are removed and stapled in two indexing movements of the array as the copy sheet processor commences the completion of the programmed job. If the job is still unfinished, the collation of copy sheets in the array 28 and stapling thereof continue in multiples of 12 until the job is completed.

In the control system of FIG. 6, the sensor SW-1 is connected to the Programmer P which includes all of the copier control functions such as ROMs and RAMs count comparator, displays, operator interface buttons and switches, etc. In the Programmer, the number of copy sets preset by the operator is stored and is counted down as they are being produced. When a signal is generated in the sensor, as being indicative of approximately 15 staples remaining, the copier logic is set up to permit continuation of the compilation of the copy set being produced, or the compilation of one or more copy sets in the sorter array and stapling thereof. In the alternative, the number of copy sets yet to be stapled is compared to the remaining number of staples, which, if lower, sets up the copier logic to permit the completion of the copy sets then being collated and stapling thereof and then places the copier in its standby condition and to hold the count of sets so far stapled. In either embodiment, if this completion of the sets in the array does not complete the preset job, then the copier is allowed to produce and collate, but not staple, another segment of copy sets, which in the illustrated system is 12 copy sets. Further production in the copier is then inhibited until the operator reloads the staple magazine, which removes the signal from the sensor SW-1, and the copier Start button on the console for the Programmer is actuated. If only one copy set remains to be stapled after detection of the low staple condition with consequent generation of the low staple signal, only one of the trays 30 will be utilized for the collation and stapling of this copy set. After this occurrence, the copier will resort to its standby condition, and inhibit restart for a new job or a repeat of the previous job.

While the present invention is described in relation to a pair of stapler devices, which utilize pre-cut and formed staples, it will be understood that the invention is as easily applicable to the use of wire spools with stitching devices. Such an application would utilize a wire length sensing device which converted remaining lengths into a predetermined number of stitching operations in accordance with the thickness of copy sets programmed.

From the foregoing, it will be appreciated that the present invention provides a control for the finishing station associated and integrated with a copier whereby the number of binding operations, whether by stapling or stitching, is related to the size of a programmed job. This relationship insures that upon a low staple condition, the job will be allowed to continue for copy sheet production and binding for a portion of the job, for example, to finish at least one copy set up to a predetermined number of copy sets, say, to fill a collating sorter for the copier/finisher, and to keep the production count so far accomplished so that upon reloading of the binding material and restarting of the copier, the count will resume where it left off before copier shutdown.

While the invention has been described with reference to the structure disclosed, it is not confined to the details set forth, but is intended to cover such modifications or changes as may come within the scope of the following claims.

I claim:

1. In a copier having a programmer for controlling a reproduction run of a preset number of stapled copy sets, and including a stapling apparatus having a clamping/stapling position whereat a plurality of sheets to be stapled are clamped preparatory to the application of a staple thereat, a magazine for holding one or more sticks of staples, and a staple follower within the magazine for contacting the end of a stick, the improvement comprising:

means for sensing a low staple condition in the magazine when there is approximately a predetermined number of staples remaining therein to be consumed, said sensing means being connected to the programmer and being cooperative therewith to permit continuation of the reproduction run and operation of said drive means until a specific segment of the reproduction run is completed, the programmer, upon completion of the segment, causing the copier to assume a standby condition and to hold the count of the number of copy sets produced after said specific segment of the run has been completed.

2. In a copier having a programmer for controlling a reproduction run of a preset number of stapled copy sets, and including a stapling apparatus having a clamping/stapling position whereat a plurality of sheets to be stapled are clamped preparatory to the application of a staple thereat, a magazine for holding one or more sticks of staples, and a staple follower within the magazine for contacting the end of a stick, the improvement comprising:

means adapted to effect movement of the staples continuously toward the clamping/stapling position, and means responsive to the positioning of said lat named means as indicative of a low staple condition in the magazine when there is approximately a predetermined number of staples remaining therein to be consumed, said responsive means being connected to the programmer and being cooperative therewith to permit continuation of the reproduction run and operation of said drive means until a specific segment of the reproduction run is completed, the programmer, upon completion of the segment, causing the copier to assume a standby condition and to hold the count of the number of copy sets produced after said segment of the run has been completed.

3. A printer having a compiler for collecting a sequential flow of copy sheets into a set, a stapler device for stapling the completed set of copy sheets, and means for programming the number of sets to be printed and stapled, comprising:

a sensor device for detecting when the quantity of staples in the stapler device attains approximately a predetermined amount, a counting circuit for continuously counting the remaining number of sets to be stapled, a comparing device for continuously comparing the count value of said count circuit relative to said predetermined amount, and a control circuit associated with the counting circuit for inhibiting the operation of the printer during a programmed job when the count value of said counting circuit is greater than said predetermined amount, said control means being arranged to prevent operation of the printer when a subsequent job is programmed in the programming means having a number of copy sets to be stapled equal to or greater than said predetermined amount.

4. In a copier/finishing system having a copy set binding device and a programmer for controlling a reproduction run of a preset number of bound copy sets, and including a sheet collecting position whereat a plurality of sheets to be bound are clamped preparatory to the application of binding material thereat, and supply means for holding binding material, the improvement comprising:

means for sensing a low supply condition of the biding material when there is approximately a predetermined number of binding operations remaining to be performed, said sensing means being connected to the programmer and being cooperative therewith to permit continuation of the reproduction run until a specific segment of the reproduction run is completed, the programmer, upon completion of the segment, causing shut down of the binding device and holding of the count of the number of copy sets so far produced.

* * * * *